US009376195B1

(12) United States Patent
Jaszewski et al.

(10) Patent No.: US 9,376,195 B1
(45) **Date of Patent: *Jun. 28, 2016**

(54) EXHAUST GAS IDLE RELIEF SYSTEM FOR AN OUTBOARD MOTOR

(71) Applicant: Brunswick Corporation, Lake Forest, IL (US)

(72) Inventors: Wayne M. Jaszewski, Jackson, WI (US); Charles H. Eichinger, Oshkosh, WI (US); Brent C. Frost, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 170 days.

This patent is subject to a terminal disclaimer.

(21) Appl. No.: 14/317,416

(22) Filed: Jun. 27, 2014

(51) Int. Cl.

| | |
|---|---|
| ***B63H 20/26*** | (2006.01) |
| ***B63H 20/24*** | (2006.01) |
| *F01N 13/12* | (2010.01) |
| *B63H 20/32* | (2006.01) |

(52) U.S. Cl.
CPC ..... *B63H 20/245* (2013.01); *B63H 20/32* (2013.01); *F01N 13/12* (2013.01); *F01N 2590/021* (2013.01)

(58) Field of Classification Search
CPC ..... B63H 20/02; B63H 20/245; B63H 20/32; F01N 13/12; F01N 2590/021; F02B 61/45
USPC ..... 440/89 G, 89 R, 89 A, 89 E, 89 D
See application file for complete search history.

(56) References Cited

U.S. PATENT DOCUMENTS

| | | | | | |
|---|---|---|---|---|---|
| 1,073,920 | A * | 9/1913 | Miller | B63H 20/34 | 440/54 |
| 2,082,059 | A * | 6/1937 | Irgens | F01N 13/00 | 416/93 R |
| 2,089,366 | A * | 8/1937 | Hansen | B63H 21/28 | 123/195 P |
| D114,597 | S * | 5/1939 | Morgan | 440/76 | |
| 4,668,199 | A | 5/1987 | Freund et al. | | |
| 4,952,182 | A | 8/1990 | Curtis et al. | | |
| 5,041,036 | A | 8/1991 | Clark et al. | | |
| 6,354,893 | B1 * | 3/2002 | Sato | B63H 20/32 | 248/640 |
| 6,450,847 | B1 | 9/2002 | Kashima et al. | | |
| 6,746,290 | B2 * | 6/2004 | Nakata | B63H 20/245 | 440/89 D |
| 7,513,811 | B2 * | 4/2009 | Kameoka | B63H 20/245 | 440/89 G |
| 7,892,057 | B1 | 2/2011 | Belter | | |
| 8,177,593 | B2 * | 5/2012 | Kazuta | B63H 21/32 | 440/89 E |
| 8,388,393 | B1 * | 3/2013 | Eichinger | B63H 21/32 | 123/195 P |
| 2014/0057508 | A1 | 2/2014 | Litjens et al. | | |

* cited by examiner

*Primary Examiner* — Andrew Polay
(74) *Attorney, Agent, or Firm* — Andrus Intellectual Property Law, LLP

(57) ABSTRACT

An outboard motor comprises an engine having an exhaust gas discharge opening, a midsection housing coupled below and supporting the engine, and an exhaust pipe having an exhaust inlet in fluid communication with the exhaust gas discharge opening. The exhaust pipe extends downwardly to a primary exhaust outlet. An idle relief port in the exhaust pipe is located in a fluid path between the exhaust inlet and the primary exhaust outlet. A sound-attenuating plenum chamber has an interior that is in fluid communication with an interior of the exhaust pipe by way of the idle relief port. The plenum chamber is a separate component that is exterior to the midsection housing, and exhaust gas flows from the interior of the exhaust pipe to the interior of the plenum chamber without first flowing through the midsection housing.

20 Claims, 7 Drawing Sheets

EXHAUST GAS IDLE RELIEF SYSTEM FOR AN OUTBOARD MOTOR

FIELD

The present disclosure relates to outboard motors configured to be coupled to a transom of a marine vessel. More specifically, the present disclosure relates to exhaust gas idle relief systems for outboard motors.

BACKGROUND

U.S. Pat. No. 4,668,199 discloses an exhaust system for an outboard motor including a main exhaust passageway extending through a partially water filled chamber in the driveshaft housing. An inlet idle relief passage connects the top of the chamber with the main exhaust passageway and an outlet passage connects the top of the chamber with the atmosphere. The system thus defines an effective exhaust silencer for the idle exhaust.

U.S. Pat. No. 4,952,182 discloses an exhaust relief system for an outboard motor including, an exhaust chamber into which exhaust is discharged from the engine. A first passage in communication with the exhaust chamber provides contraction of the exhaust as the exhaust passes rearwardly, from which the exhaust is discharged into an expansion chamber which substantially surrounds the exhaust chamber. From the expansion chamber, the exhaust is routed through and contracted into a second passage in communication with the expansion chamber, after which it is discharged to atmosphere. The tortuous path provided by the exhaust relief system of the invention, along with the repeated expansion and contraction of the exhaust as it flows to atmosphere, provides a muffling effect at idle operation.

U.S. Pat. No. 5,041,036 discloses an outboard motor comprising an internal combustion engine including a lower surface having therein an exhaust gas discharge port, a driveshaft housing having an upper end including an upper face fixed to the lower surface of the internal combustion engine, an outer surface extending downwardly from the upper face, an interior vertically extending main exhaust gas passage extending from the upper face and communicating with the exhaust gas discharge port, an idle exhaust gas relief passage recessed in the upper face and in spaced relation to the main exhaust gas passage, and closed by the lower surface of the internal combustion engine, and an idle exhaust gas outlet port located in the outer surface and communicating with the idle exhaust gas relief passage, and an idle exhaust gas relief tube communicating between the main exhaust gas passage and the idle exhaust gas relief passage and having a portion extending vertically within the main exhaust gas passage and terminating in spaced relation above the water level in the driveshaft housing when the driveshaft housing is located in a normal operating position and when the driveshaft housing is at rest relative to the water.

U.S. Pat. No. 7,892,057 discloses an idle exhaust relief passage provided with a valve that can inhibit flow through the passage in response to certain operating conditions of an engine of an outboard motor. More particularly, operation above a predetermined threshold can be used to inhibit flow through the idle exhaust relief passage. A valve, configured for this purpose, can be a flapper valve.

U.S. Patent Application Publication No. 2014/0057508 discloses a marine propulsion system for propelling a marine vessel in water. The system comprises an outboard motor that is coupled to a marine vessel, and that comprises an exhaust gas relief outlet that is located above the water when the outboard motor is at idle speed. A conduit conveys exhaust gas from the exhaust gas relief outlet to a discharge outlet located on the marine vessel.

The disclosures of each of the above-mentioned patents and patent application publications are hereby incorporated by reference in their entireties.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One example of the present disclosure is of an outboard motor comprising an engine having an exhaust gas discharge opening and a midsection housing coupled below and supporting the engine. The outboard motor has an exhaust pipe having an exhaust inlet in fluid communication with the exhaust gas discharge opening, the exhaust pipe extending downwardly to a primary exhaust outlet. An idle relief port in the exhaust pipe is located in a fluid path between the exhaust inlet and the primary exhaust outlet. The outboard motor further includes a sound-attenuating plenum chamber having an interior that is in fluid communication with an interior of the exhaust pipe by way of the idle relief port. The plenum chamber is a separate component that is exterior to the midsection housing, and exhaust gas flows from the interior of the exhaust pipe to the interior of the plenum chamber without first flowing through the midsection housing.

Another example of the present disclosure is of an exhaust gas idle relief system for an outboard motor having an engine supported by a midsection housing coupled to a transom of a marine vessel. The system comprises an exhaust pipe having an exhaust inlet for receiving exhaust gases from the engine and a primary exhaust outlet for discharging the exhaust gases, the exhaust pipe being located exterior to the midsection housing. An idle relief port is located downstream of the exhaust inlet and upstream of the primary exhaust outlet. The system includes a sound-attenuating plenum chamber having an interior that is in fluid communication with an interior of the exhaust pipe by way of the idle relief port, the plenum chamber being located exterior to the midsection housing. When the engine is idling, exhaust gas flows from the exhaust pipe, through the idle relief port, and into the plenum chamber, but does not flow through the midsection housing.

BRIEF DESCRIPTION OF THE DRAWINGS

The present disclosure is described with reference to the following Figures. The same numbers are used throughout the Figures to reference like features and like components.

DETAILED DESCRIPTION

In the present description, certain terms have been used for brevity, clarity and understanding. No unnecessary limitations are to be inferred therefrom beyond the requirement of the prior art because such terms are used for descriptive purposes only and are intended to be broadly construed.

Figure 1:
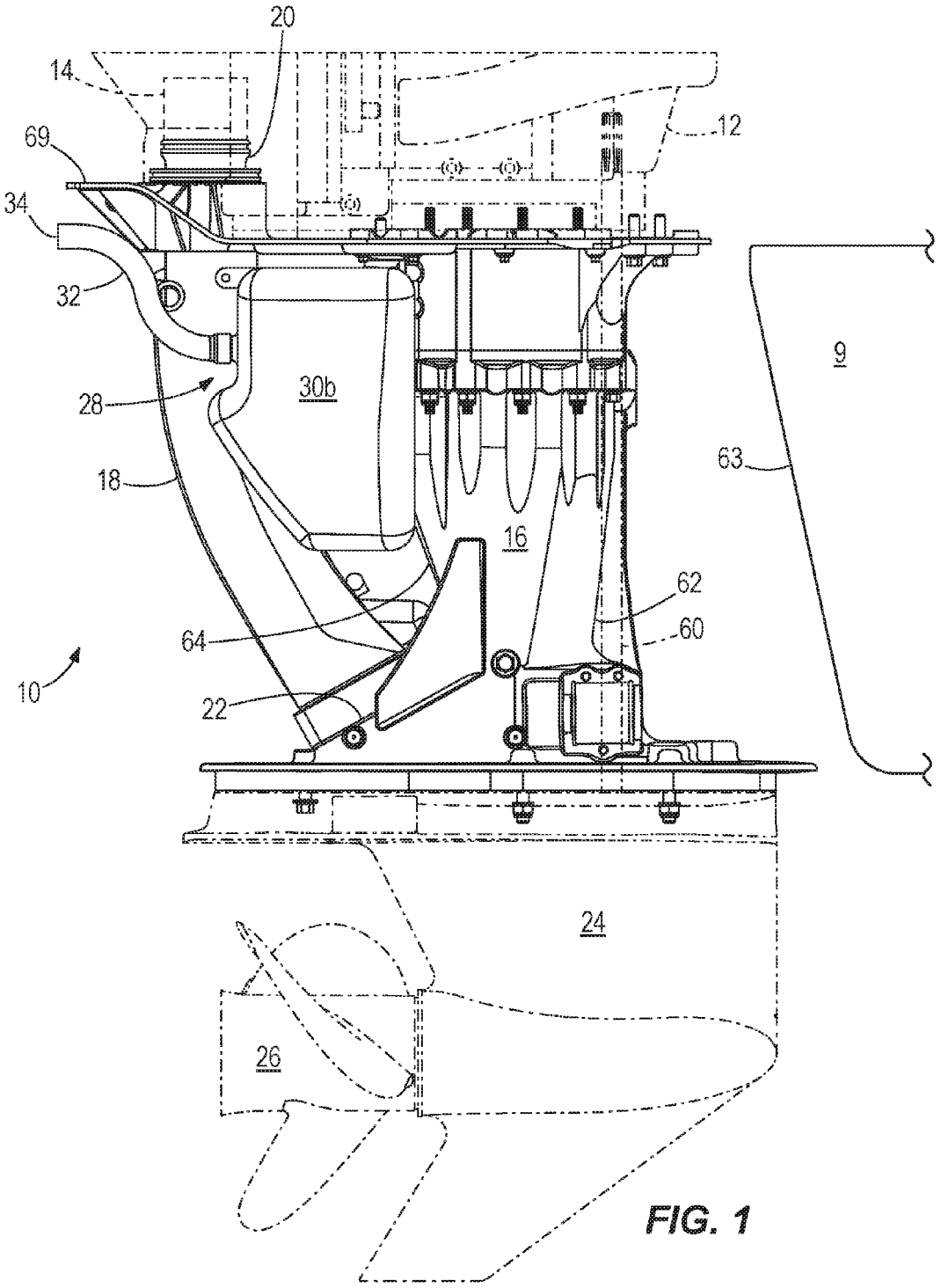
FIG. 1 illustrates a side view of portions of an outboard motor according, to the present disclosure.

FIG. 1 illustrates a partial view of an outboard motor 10 comprising an engine 12 having an exhaust gas discharge opening 14. The outboard motor 10 may be coupled to a transom 63 of a marine vessel 9 via an adapter plate 69, although such coupling is not shown here for purposes of clarity. The outboard motor 10 further comprises a midsection housing 16 coupled below and supporting the engine 12. An exhaust pipe 18 has an exhaust inlet. 20 in fluid communication with the exhaust gas discharge opening 14. The exhaust pipe 18 extends downwardly from the exhaust inlet 20 to a primary exhaust outlet 22 (see also FIG. 4). From there, exhaust gas is conveyed through a gearbox assembly 24 and eventually out the hub of a propeller 26 to discharge the exhaust gas under water.

When the engine 12 is idling and the marine vessel 9 to which it is attached is moving at low speeds or is stationary, the marine vessel 9 sits low in the water, creating a hack pressure in the exhaust pipe 18 that may negatively affect performance of the engine 12. To prevent an elevated back pressure at low and idle speed conditions, an idle relief system 28 is provided. The idle relief system 28 includes a sound-attenuating plenum chamber 30*b* having in interior that is in fluid communication with an interior of the exhaust pipe 18 as will be described further herein below. The idle relief system 28 further comprises an idle relief outlet pipe 32 for discharging idle relief exhaust gases to an atmosphere surrounding the outboard motor 10. An outlet end 34 of the idle relief outlet pipe 32 is located at a position that is likely not to be submerged under water when the engine 12 is idling, or operating at low speeds.

Figure 3:
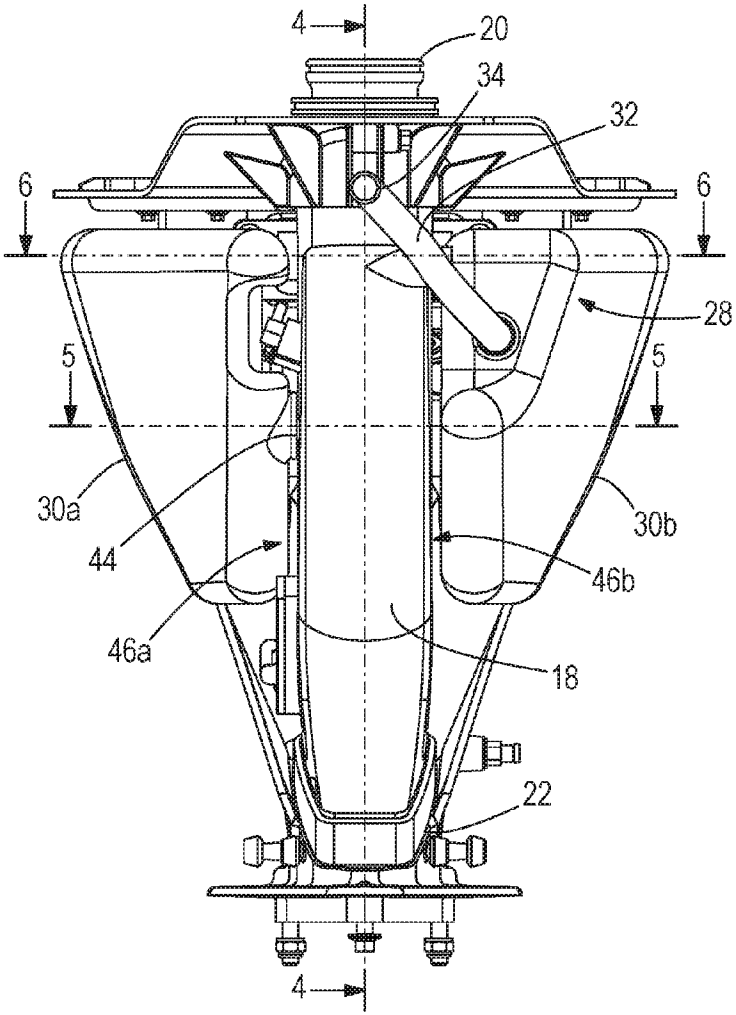
FIG. 3 illustrates a rear view of the midsection housing of FIG. 2.
Figure 2:
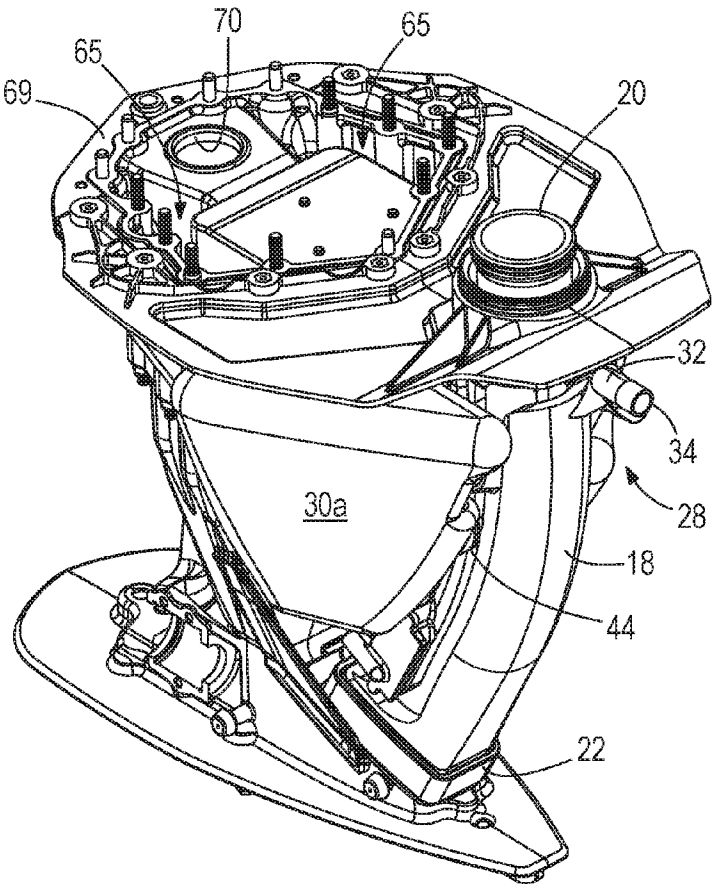
FIG. 2 illustrates a perspective view of a midsection housing of the outboard motor of FIG. 1.

FIG. 2 illustrates a perspective view of the midsection housing 16 so as to illustrate the exhaust inlet 20 of the exhaust pipe 18, as well as the idle relief outlet pipe 32 and the outlet end 34 of the pipe 32. As can be seen in FIGS. 2 and 3, the midsection housing 16 includes two sound-attenuating plenum chambers, a first sound-attenuating plenum chamber 30*a* and a second sound-attenuating plenum chamber 30*b*, which was already shown in FIG. 1. Each of the plenum chambers 30*a*, 30*b* is a separate component of the outboard motor 10 that is exterior to the midsection housing 16. Although two plenum chambers 30*a*, 30*b* are shown herein, it should be understood that an outboard motor 10 could be provided with only one plenum chamber and still fall within the scope of the present claims.

Figure 4:
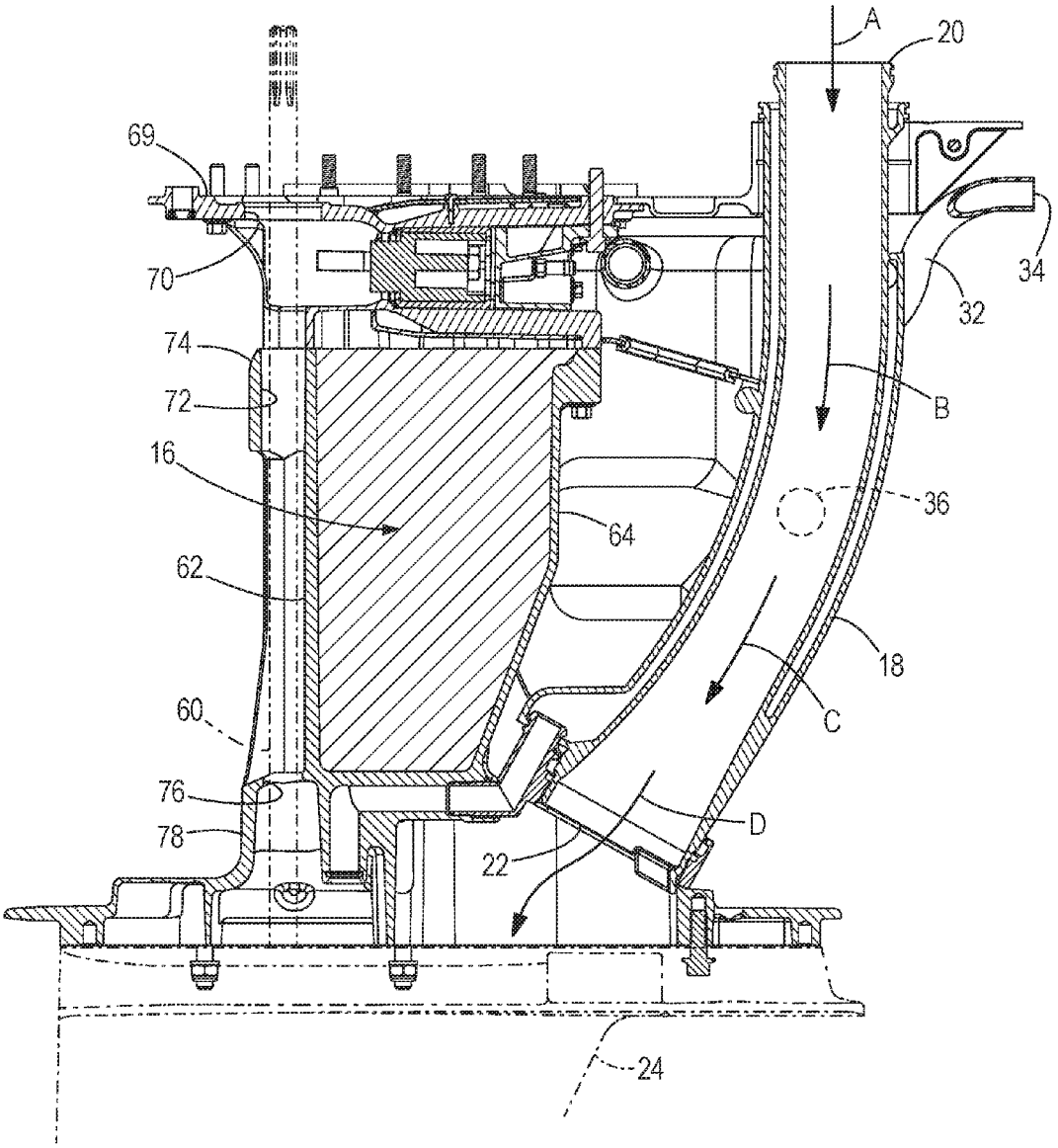
FIG. 4 illustrates a side, cross-sectional view of the midsection housing.

Turning to FIG. 4, the flow of exhaust gases through the exhaust pipe 18 will be described. Exhaust gases enter the exhaust inlet 20 as shown by arrow A. The exhaust gases continue down the exhaust pipe 18 toward the exhaust outlet 22 as shown by the arrows B and C within the exhaust pipe 18. Finally, the exhaust gases exit the exhaust outlet 22 as shown by the arrow D and continue into the gearbox assembly 24 as described herein above with reference to FIG. 1. Together, the arrows A, B, C, and D represent a fluid path within the exhaust pipe 18. As described herein above, this is the path that exhaust gases follow when the engine 12 is above idle and/or running at faster speeds.

Figure 5:
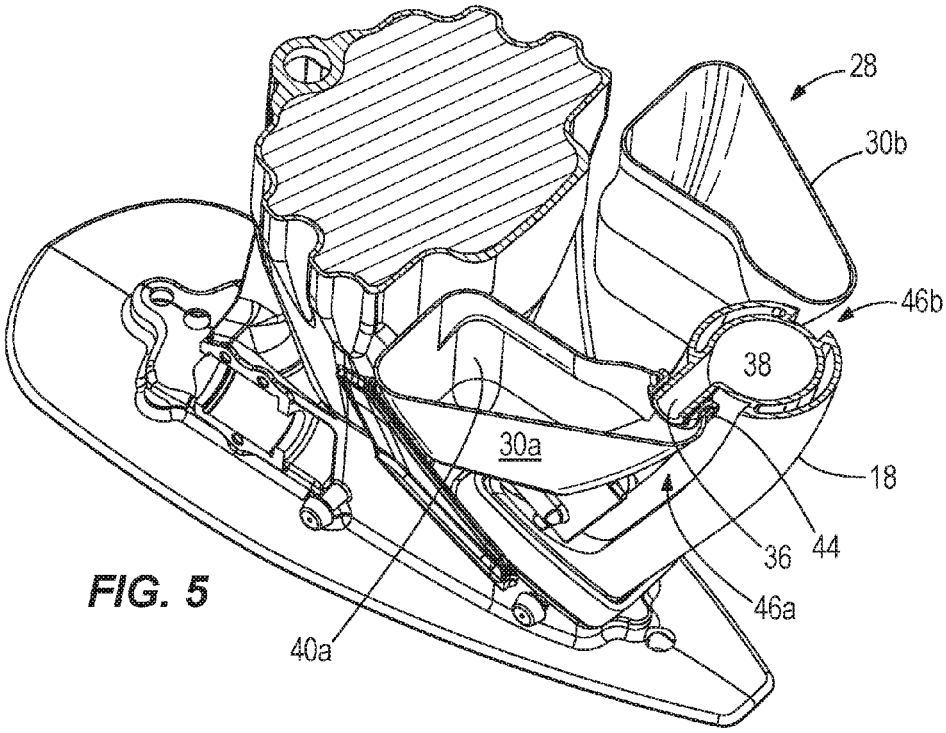
FIG. 5 illustrates a cross-section through the line 5-5 of FIG. 3.

Now referring to FIGS. 4 and 5, further details of the idle relief system 28 will be described. The exhaust pipe 18 has an idle relief port 36 that is located in a fluid path between the exhaust inlet 20 and the primary exhaust outlet 22 of the exhaust pipe 18 (shown by the arrows B and C in FIG. 4). An approximate location of the idle relief port 36 is shown by dashed lines in FIG. 4. As shown in FIG. 5, the idle relief port 36 may be a cylindrical protrusion that is integrally molded with the exhaust pipe 18 and therefore is in fluid communication with an interior 38 of the exhaust pipe 18. The idle relief port 36 may comprise a short passageway as shown herein, may be a longer pipe or tube, or may be little more than a cylindrical fitting. The passageway of the idle relief port 36 extends from the exhaust pipe 18 to the plenum chamber 30*a*. The plenum chamber 30*a* has an interior 40*a* that is in fluid communication with the interior 38 of the exhaust pipe 18 by way of the idle relief port 36.

Figure 8:
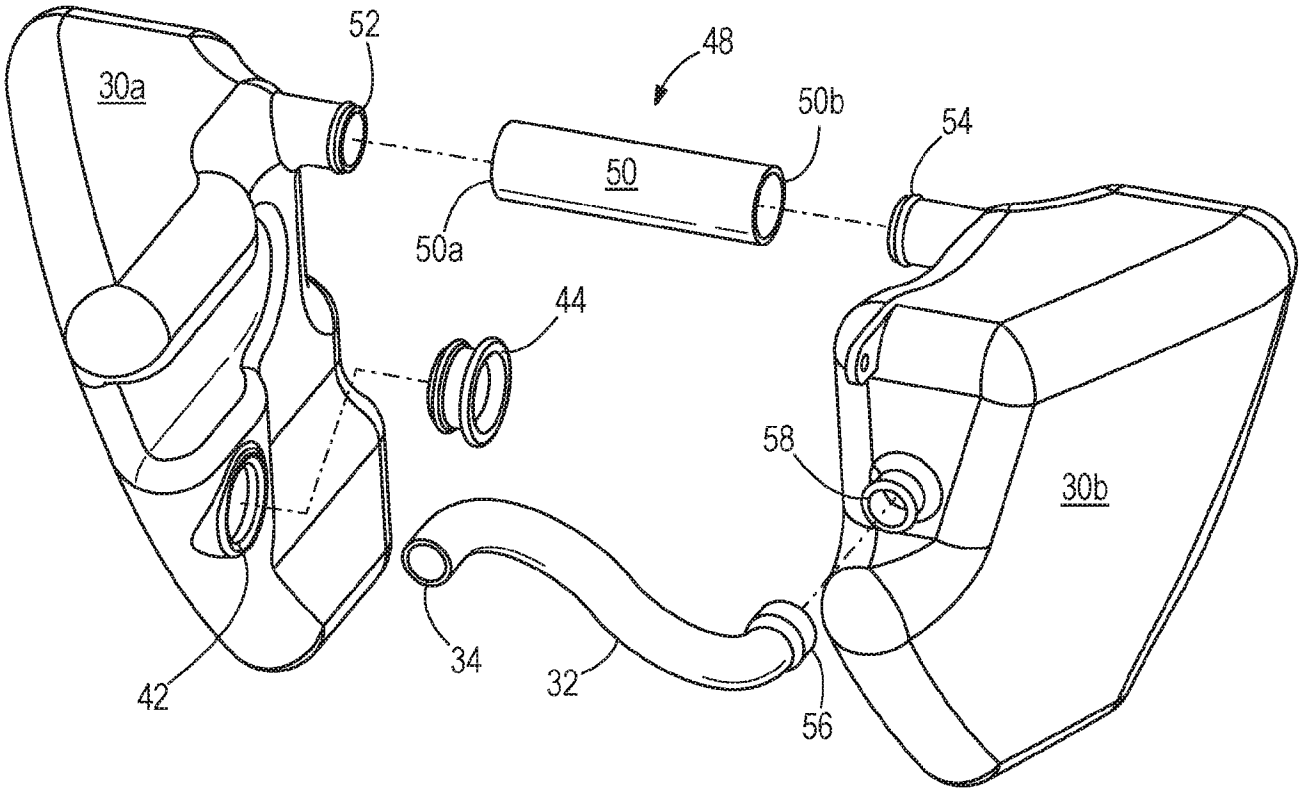
FIG. 8 illustrates an exploded view of one example of plenum chambers that can provided as part of an outboard motor according to the present disclosure.

With reference to both FIGS. 5 and 8, the plenum chamber 30*a* comprises an aperture 42 in its side that is proximate the exhaust pipe 18, which aperture 42 has a fitting 44 provided therein. This fitting 44 receives the protruding idle relief port 36 and provides a fluid tight connection between the interior 38 of the exhaust pipe 18 and the interior 40*a* of the plenum chamber 30*a*. When the engine 12 is idling or at low speed, and the pressure of exhaust gas is too low to overcome a back pressure at the primary exhaust outlet 22, the exhaust gas flows from the interior 38 of the exhaust pipe, through the idle relief port 36, and into the interior 40*a* of the plenum chamber 30*a*.

Figure 6:
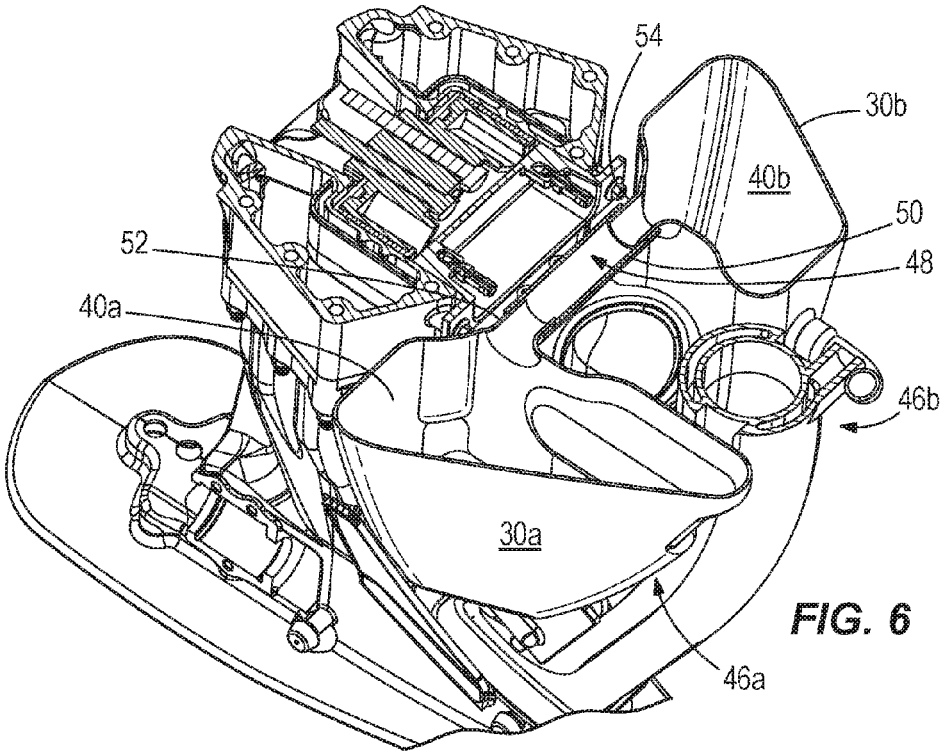
FIG. 6 illustrates a cross-section through the line 6-6 of FIG. 3.

As shown in FIGS. 3 and 5-6, the first and second plenum chambers 30*a*, 30*b* at least partially flank the exhaust pipe 18 on first and second sides 46*a*, 46*b* of the exhaust pipe 18. The idle relief port 36 in the exhaust pipe 18 is in direct fluid communication with the first plenum chamber 30*a* via the fitting 44 and aperture 42 provided in the first plenum chamber 30*a*. A coupling passageway 48 provides fluid communication between the first and second plenum chambers 30*a*, 30*b*. The coupling passageway 48 comprises a short piece of tube or pipe 50 having opposite ends 50*a*, 50*b* that fit around extruded ports 52, 54 in the first and second plenum chambers, 30*a*, 30*b* respectively. The opposite ends 50*a*, 50*b* of the pipe 50 fit around the extruded ports 52, 54 in a fluid-tight manner. The passageway 48 extends across the exhaust pipe 18 such that fluid communication can be provided between the first and second plenum chambers 30*a*, 30*b*, despite their being located on either side of the exhaust pipe 18.

The idle relief outlet pipe 32 is shown in further detail in FIG. 8. The idle relief outlet pipe 32 comprises a first end 56 that is coupled in fluid tight communication with an extruded port 58 located in a height-wise middle portion of the second plenum chamber 30*b*. The idle relief outlet pipe 32 curves in an S-shape and extends upwardly from a middle to lower portion of the second plenum chamber 30*b* towards its outlet end 34. This curvature ensures that the outlet end 34 is well above a body of water in which the marine vessel is operating. In this way, the idle relief outlet pipe 32 provides fluid communication between the second plenum chamber 30*b* and an atmosphere surrounding the outboard motor 10.

When the engine 12 is idling, exhaust gas first flows through the exhaust pipe 18, next through the idle relief port 36 into the first plenum chamber 30*a*, next through the coupling passageway 48 into the second plenum chamber 30*b*, and next through the idle relief outlet pipe 32 to the atmosphere. As shown in FIGS. 5-8, the idle relief port 36 is in fluid communication with a middle to lower portion of the first plenum chamber 30*a*, the coupling passageway 48 is in fluid communication with an upper to middle portion of the first plenum chamber 30*a* and with an upper to middle portion of the second plenum chamber 30*b*, and the idle relief outlet pipe 32 is in fluid communication with a middle to lower portion of the second plenum chamber 30*b*. The locations of the inlets and outlets to the plenum chambers 30*a*, 30*b* and the connections there between create a tortuous path for the idle relief gas. Coupled with continual expansion and contraction of the idle relief gas as it passes through the numerous passageways, pipes, and plenums, this attenuates noise created by the idle relief gas. It should be noted that the connections between the exhaust pipe 18 and plenum chambers 30*a*, 30*b* shown herein are not the only possible paths for routing idle relief gas, and that various other routing paths could be created and still fall within the scope of the appended claims.

Figure 7:
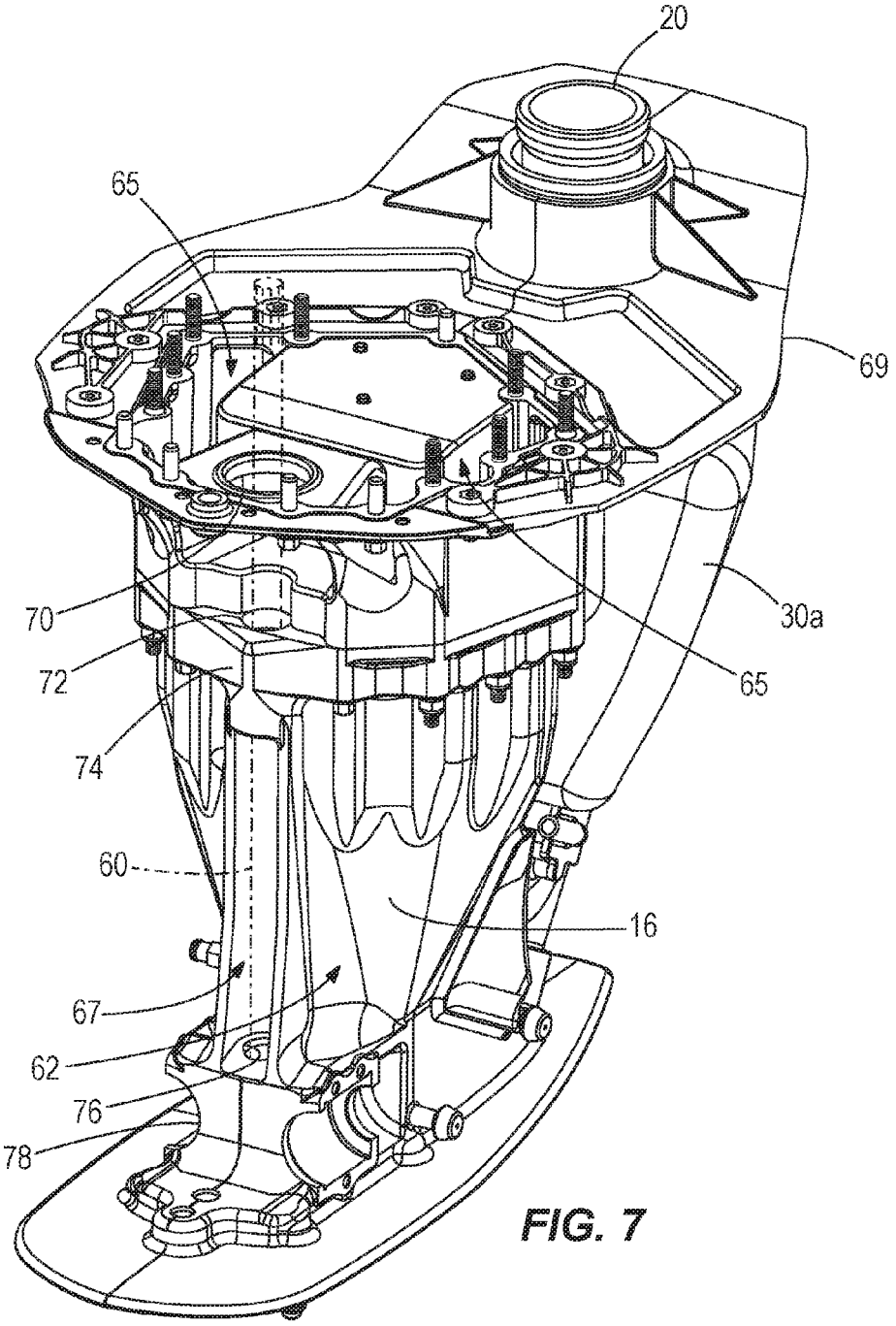
FIG. 7 illustrates as front perspective view of the midsection housing.

Referring now to FIGS. 1 and 7, the outboard motor 10 further comprises a driveshaft 60 coupled in torque transmitting relation with a crankshaft (not shown) of the engine 12. The driveshaft 60 is located proximate a front side 62 of the midsection housing 46. The front side 62 of the midsection housing 16 is configured to face a transom 63 of a marine vessel to which the outboard motor 10 may be coupled. Such coupling to the transom 63 is not shown herein for the sake of clarity of the drawings, but could be made with a mounting system that connects to an adapter plate 69, as known to those having ordinary skill in the art. As shown in FIG. 7, a portion of the driveshaft 60 is located exterior to the midsection housing 16, in a sort of alcove 67 provided on the front side 62 of the midsection housing 16. For example, as shown in FIGS. 4 and 7, an upper portion of the driveshaft 60 extends through an aperture 70 in the adapter plate 69. Immediately below this, the driveshaft 60 is exterior to the midsection housing 16. Below this, the driveshaft 60 runs through another aperture 72 in a forwardly protruding portion 74 of the midsection housing 16. Immediately below this, the driveshaft 60 again extends exterior to the midsection housing 16, and is located in the alcove 67. Below this, the driveshaft 60 extends through an aperture 76 in another forwardly protruding portion 78 of the midsection housing 16. Each of the apertures 70, 72, 76 is provided with a seal (not shown) for preventing fluid from passing through the respective aperture.

The exhaust pipe 18 is located exterior to the midsection housing 16 as well, and is proximate an opposite, back side 64 of the midsection housing 16. Partially locating the driveshaft 60 and wholly locating the exhaust pipe 18 exterior to the midsection housing 16 allows the midsection housing 16 to be made smaller because it houses fewer components. A smaller midsection housing 16 is therefore lighter, as less aluminum is needed to cast the housing. The need for less aluminum also means the midsection housing 16 can be made less expensively.

Prior art systems provide sound attenuation by routing idle relief gas from the exhaust pipe into the interior of the midsection housing. These prior art systems require the midsection housing to have cavities cast into the aluminum housing for sound attenuation, which add weight and cost to the system. In contrast, in the present disclosure, when the engine 12 is idling or operating at a low speed, the idle relief gases does not enter the interior of the midsection housing 16. Rather, when the engine 12 is idling, or at low speed, exhaust gas flows from the interior 38 of the exhaust pipe 18 to the interior 40*a* of the plenum chamber 30*a* without first flowing through the midsection housing 16. Sound attenuation of the idle relief gas is thereafter accomplished by the first and second plenum chambers 30*a*, 30*b* in series. Because, in the present disclosure, sound attenuation is provided by plenum chambers 30*a*, 30*b* that are separate components from the midsection housing 16 and that are exterior to the midsection housing 16, the aluminum midsection housing 16 itself can be made much smaller and therefore lighter than prior an designs. In another example, where only one plenum chamber 30*a* or 30*b* is provided, idle relief gas may be routed from the idle relief outlet port 36 to the plenum chamber 30*a*, or 30*b*, and thereafter out the idle relief outlet pipe 32 without entering the interior of the midsection housing 16. In other examples, the flow path for the idle relief gas may be through the midsection housing 16, but only briefly before or after the flow path is through the plenum chamber(s) 30*a*, 30*b*. In other words, the midsection housing 16 may be used as a conduit to carry idle relief gas to or from the plenum chamber(s) 30*a*, 30*b*, but according to the present disclosure is not used as the primary sound attenuation device itself.

In one example, the plenum chambers 30*a*, 30*b* are made of a plastic polymer. Plastic polymers that could be used include, but are not limited to, high density polyethylene (HDPE) or polypropylene, although it should be understood that any non-aluminum and/or non-metallic material may be used in order to provide both strength and yet capitalize on weight and cost reduction of the outboard motor 10 as a whole, over prior art designs that use cast-aluminum cavities for attenuating idle relief gas noise.

The presently disclosed design therefore provides as good or better sound attenuation than do prior an designs, especially as larger or more complex plenums can be created using the plastic polymer, with equal or less weight than prior art cast-aluminum cavities. In other words, the midsection housing 16 of the present design can be smaller, lighter, and less expensive than prior art designs because the presently-disclosed midsection housing 16 no longer is required to have a large volume for adequate sound attenuation of the idle relief gas, does not fully enclose the driveshaft 60, and does not contain the exhaust pipe 18.

Further weight reduction cart be achieved by having the midsection housing 16 serve as an integral sump for oil that lubricates the engine 12. For example, with reference to FIGS. 2 and 7, a top surface of the midsection housing 16 may be left open, as shown at arrows 65, in order to allow for oil that returns from the engine 12 to be collected in the midsection housing 16.

Figure 11:
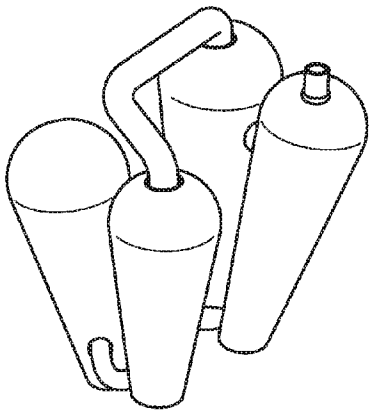
FIGS. 9-13 illustrate other examples of plenum chambers that can be provided as part of an outboard motor according to the present disclosure.
Figure 13:
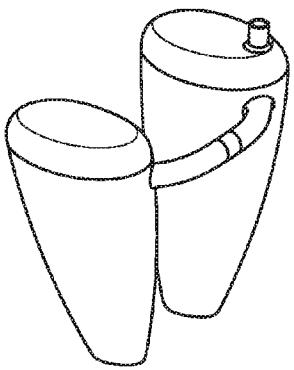
Figure 10:
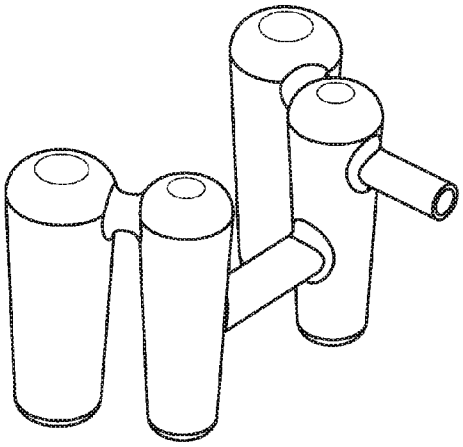
Figure 9:
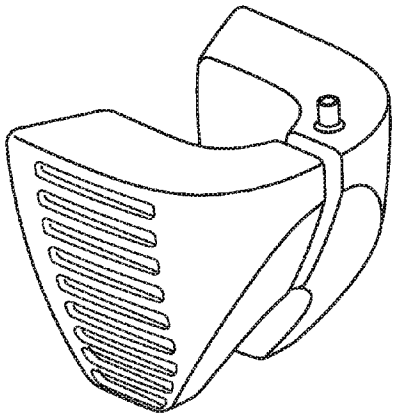
Figure 12:
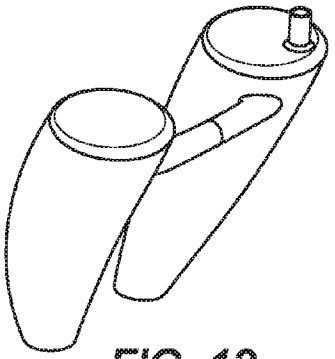

Other features of the system include, but are not limited to, providing ribs in the plenum chambers 30*a*, 30*b* in order to provide for further sound attenuation and/or provide structural integrity to the plenum chambers 30*a*, 30*b* (see FIG. 9). Further, the plenum chambers may be lung-shaped as shown in FIGS. 1-8 and 9, or may take other shapes such as a sphere shape, a cylinder shape (FIGS. 10 and 11), or a cone shape (FIGS. 12 and 13). Additionally, any number of plenum chambers could be provided. For example, four plenum chambers are shown in each of FIGS. 10-13, which provide even further continual expansion and contraction of idle relief gas, as well as a tortuous path, for sound attenuation. In another example, only one plenum chamber may be provided.

Although the plenum chambers 30*a*, 30*b* shown herein are used in conjunction with a midsection housing 16 that acts as an oil sump and that has a driveshaft 60 and exhaust pipe 18 exterior thereto, it should be understood by those having ordinary skill in the art that the plenum chambers 30*a*, 30*b* could be provided for use with a prior art outboard motor comprising a more conventional midsection that acts as a driveshaft housing, and that minimal experimental effort would be required to retrofit such a conventional driveshaft housing for use with the plenum chambers 30*a*, 30*b* shown herein. Further, it is contemplated that a secondary muffler may be utilized, with the combination shown in the present disclosure. This secondary muffler may be provided at the outlet end 34 of the idle relief outlet pipe 32 and may provide additional silencing depending on how quiet the engine 12 is required to be for any given application.

Therefore, the present disclosure is of an exhaust gas idle relief system 28 for an outboard motor 10 having an engine 12 supported by a midsection housing 16 coupled to a transom 63 of a marine vessel 9. The system 28 comprises an exhaust pipe 18 having an exhaust inlet 20 for receiving exhaust gases from the engine 12 and a primary exhaust outlet 22 for discharging the exhaust gases. The exhaust pipe 18 is located exterior to the midsection housing 16. An idle relief port 36 is located in the exhaust pipe 18 downstream of the exhaust inlet 20 and upstream of the primary exhaust outlet 22. A sound-attenuating plenum chamber 30*a* having an interior 40*a* that is in fluid communication with an interior 38 of the exhaust pipe 18 by way of the idle relief port 36 is also provided. The plenum chamber 30*a* is located exterior to the midsection housing 16. When the engine is idling, exhaust gas flows from the exhaust pipe 18 through the idle relief port 36 and into the plenum chamber 30*a*, but does not flow through the midsection housing 16.

The system 28 further comprises first and second plenum chambers 30*a*, 30*b*, the first and second plenum chambers 30*a*, 30*b* at least partially flanking the exhaust pipe 18 on first and second sides 46*a*, 46*b* of the exhaust pipe 18. The idle relief port 36 is in direct fluid communication with the first plenum chamber 30*a*, such as, for example, by extending through the aperture 42 and fitting 44 provided in the first plenum chamber 30*a*. The system 28 further comprises a coupling passageway 48 providing fluid communication between the first and second plenum chambers 30*a*, 30*b*. As shown in the example, the passageway 48 may comprise a pipe 50 that is connected on a first end 50*a* to an extruded port 52 of the first plenum chamber 30*a* and on a second end 50*b* to an extruded port 54 of the second plenum chamber 30*b*.

The system 28 further comprises an idle relief outlet pipe 32 providing fluid communication between the second plenum chamber 30*b* and an atmosphere surrounding the outboard motor 10. When the engine 12 is idling, exhaust gas flows first through the exhaust pipe 18, next through the idle relief port 36 into the first plenum chamber 30*a*, next through the coupling passageway 48 into the second plenum chamber 30*b*, and next through the idle relief outlet pipe 32 to the atmosphere. The idle relief port 36 is in fluid communication with a middle to lower portion of the first plenum chamber 30*a*, the coupling passageway 48 is in fluid communication with an upper to middle portion of the first plenum chamber 30*a* and an upper to middle portion of the second plenum chamber 30*b*, and the idle relief outlet pipe 32 is in fluid communication with a middle to lower portion of the second plenum chamber 30*b*.

In the present description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein ma be used alone or in combination with other systems and methods. It is to be expected that various equivalents, alternatives and modifications are possible within the scope of the appended claims. Each limitation in the appended claims is intended to invoke interpretation under 35 U.S.C. §112(f), only if the terms "means for" or "step for" are explicitly recited in the respective limitation.

What is claimed is:

1. An outboard motor comprising:

an engine having an exhaust gas discharge opening;

a midsection housing coupled below and supporting the engine;

an exhaust pipe having an exhaust inlet in fluid communication with the exhaust gas discharge opening, the exhaust pipe extending downwardly to a primary exhaust outlet;

an idle relief port in the exhaust pipe, the idle relief port located in a fluid path between the exhaust inlet and the primary exhaust outlet; and a sound-attenuating plenum chamber having an interior that is in fluid communication with an interior of the exhaust pipe by way of the idle relief port;

wherein the plenum chamber is a separate component that is exterior to the midsection housing; and wherein exhaust gas flows from the interior of the exhaust pipe to the interior of the plenum chamber without first flowing through the midsection housing.

2. The outboard motor of claim 1, further comprising a driveshaft coupled in torque transmitting relation with a crankshaft of the engine, wherein a portion of the driveshaft is located exterior to the midsection housing.

3. The outboard motor of claim 2, wherein the driveshaft is located more proximate a front side of the midsection housing than a back side of the midsection housing, the front side being configured to face a transom of a marine vessel to which the outboard motor may be coupled.

4. The outboard motor of claim 3, wherein the exhaust pipe is located exterior to the midsection housing and more proximate the back side of the midsection housing than the front side of the midsection housing.

5. The outboard motor of claim 1, further comprising first and second plenum chambers, the first and second plenum chambers at least partially flanking the exhaust pipe on first and second sides of the exhaust pipe, wherein the idle relief port is in direct fluid communication with the first plenum chamber.

6. The outboard motor of claim 5, further comprising a coupling passageway providing fluid communication between the first and second plenum chambers.

7. The outboard motor of claim 6, further comprising an idle relief outlet pipe providing fluid communication between the second plenum chamber and an atmosphere surrounding the outboard motor.

8. The outboard motor of claim 7, wherein, when the engine is idling, exhaust gas flows first through the exhaust pipe, next through the idle relief port into the first plenum chamber, next through the coupling passageway into the second plenum chamber, and next through the idle relief outlet pipe to the atmosphere.

9. The outboard motor of claim 8, wherein the idle relief port is in fluid communication with a middle to lower portion of the first plenum chamber, the coupling passageway is in fluid communication with an upper to middle portion of the first plenum chamber and an upper to middle portion of the second plenum chamber, and the idle relief outlet pipe is in fluid communication with a middle to lower portion of the second plenum chamber.

10. The outboard motor of claim 1, wherein the midsection housing serves as a sump for oil that lubricates the engine.

11. The outboard motor of claim 1, wherein the plenum chamber is made of a plastic polymer.

12. An exhaust gas idle relief system for an outboard motor having an engine supported by a midsection housing coupled to a transom of a marine vessel, the system comprising:

an exhaust pipe having an exhaust inlet for receiving exhaust gases from the engine and a primary exhaust outlet for discharging the exhaust gases, the exhaust pipe being located exterior to the midsection housing;

an idle relief port located in the exhaust pipe downstream of the exhaust inlet and upstream of the primary exhaust outlet; and a sound-attenuating plenum chamber having an interior that is in fluid communication with an interior of the exhaust pipe by way of the idle relief port, the plenum chamber being located exterior to the midsection housing;

wherein, when the engine is idling, exhaust gas flows from the exhaust pipe, through the idle relief port, and into the plenum chamber, but does not flow through the midsection housing.

13. The system of claim 12, further comprising first and second plenum chambers, the first and second plenum chambers at least partially flanking the exhaust pipe on first and second sides of the exhaust pipe, wherein the idle relief port is in direct fluid communication with the first plenum chamber.

14. The system of claim 13, further comprising a coupling passageway providing fluid communication between the first and second plenum chambers.

15. The system of claim 14, further comprising an idle relief outlet pipe providing fluid communication between the second plenum chamber and an atmosphere surrounding the outboard motor.

16. The system of claim 15, wherein, when the engine is idling, exhaust gas flows first through the exhaust pipe, next through the idle relief port into the first plenum chamber, next through the coupling passageway into the second plenum chamber, and next through the idle relief outlet pipe to the atmosphere.

17. The system of claim 16, wherein the idle relief port is in fluid communication with a middle to lower portion of the first plenum chamber, the coupling passageway is in fluid communication with an upper to middle portion of the first plenum chamber and an upper to middle portion of the second plenum chamber, and the idle relief outlet pipe is in fluid communication with a middle to lower portion of the second plenum chamber.

18. The system of claim 13, wherein the first and second plenum chambers are lung-shaped.

19. The system of claim 12, wherein the plenum chamber is made of a plastic polymer.

20. The system of claim 19, wherein the plastic polymer is high density polyethylene.

* * * * *